United States Patent [19]

Fenske et al.

[11] Patent Number: 4,732,377

[45] Date of Patent: Mar. 22, 1988

[54] DEVICE FOR CONTROLLING GUIDING TONGUES OF A PRODUCT DIVERTER

[75] Inventors: Horst Fenske, Leipzig; Rudolf Störr, Karl-Marx-Stadt, both of German Democratic Rep.

[73] Assignee: Veb Kombinat Polygraph "Werner Lamberz" Leipzig, Leipzig, Fed. Rep. of Germany

[21] Appl. No.: 24,381

[22] Filed: Mar. 10, 1987

[30] Foreign Application Priority Data

Mar. 10, 1986 [DD] German Democratic Rep. ... 287715

[51] Int. Cl.[4] ..... B65H 29/58

[52] U.S. Cl. ..... 271/303

[58] Field of Search ..... 271/303, 305, 308, 312

[56] References Cited

U.S. PATENT DOCUMENTS 1,107,272 8/1913 Spiess ..... 271/303

FOREIGN PATENT DOCUMENTS 1044589 9/1958 Fed. Rep. of Germany .
2229286 3/1976 Fed. Rep. of Germany .
2559138 12/1977 Fed. Rep. of Germany .
340839 10/1959 Switzerland ..... 271/303

*Primary Examiner*—Richard A. Schacher
*Attorney, Agent, or Firm*—Michael J. Striker

[57] ABSTRACT

In a rotary machine for processing a series of sheet-shaped products supplied at a rate which is synchronized with the machine cycles, a device for diverting the stream of products to processing directions in accordance with a desired mode of operation. The device includes at least one guiding tongue pivotably supported in the path of movement of the products. A cam disk attached to a driven gear is supported for rotation at a free end of a rocking arm whose other end is pivotably supported on the machine frame. A cam follower lever is spring biased into engagement with the cam disk and at its end is fixedly connected to the pivot shaft of the guiding tongue. The rocking arm is linked to a control device which either electrically or electromechanically by means of two solenoids sets the rocking arm in at least three different angular positions in dependency on the selected mode of stream diverting operation.

5 Claims, 2 Drawing Figures

DEVICE FOR CONTROLLING GUIDING TONGUES OF A PRODUCT DIVERTER

BACKGROUND OF THE INVENTION

The present invention relates to a device for operating guiding tongues of a product diverter for use, for example in polygraphic machines. The product diverter of this kind is designed for diverting a stream of sheets to be folded, for example, or diverting singular sheets to different paths.

From DE-PS No. 1,044,589 a device for sorting out defective sheets is known wherein a cam disk driven synchronously with a cross cutter moves via a lever system the guiding tongues of the diverter until the movements of the cam disk are inactivated by means of an electromagnetic locking mechanism. This known device, however, enables the sorting of sheets having predetermined fixed characteristics but cannot selectively divide the entire stream of sheets or alternately divert selected sheets from the stream to different directions.

Known are also devices which divide a stream of products or sheets in such a manner that one product is diverted in one direction and the next product is diverted in another direction. For example, DE-AS No. 25 59 138 discloses a diverter for directing flat workpieces from a conveyor belt onto two subsequent conveyor belts. The guiding tongues in this prior art device alternately receive driving impulses through springs activated upon the release of locking pawls or catches tensioned in reciprocating cycles by means of a crank drive of a sliding wedge mechanism which also releases the locking pawls. It is true that devices of this kind are suitable for dividing a stream workpieces. Nevertheless, their main disadvantage is the inability to alternate the division of the stream of the workpieces or to divert at a predetermined time point the entire stream to one or other direction. Another disadvantage of these known devices is a high noise level during operation.

Another device of this kind is known from DE-AS No. 22 29 286 which serves for sorting out defecting pieces in paper processing machines and offers the possibility to divert after a predetermined number of pieces, the path of their transportation. A synchronized locking mechanism cooperates with a pneumatic double-acting locking cylinder controlled by different signals. By means of the working cylinder a pressure accumulator is created for an instantaneous switchover when a gap in the product stream occurs. This mechanism which is advantageous for a synchronized control is also unable to solve the problem of an alternating switchover at a high frequency because the relatively high inertia of the pneumatic drive and the numerous additional control members prevent such fast changes.

SUMMARY OF THE INVENTION

It is, therefore, a general object of this invention to provide a device for actuation of guiding tongues of a product diverter which is versatile in application and can be employed both in connection with rotary folders, for example for dividing a stream of sheet shaped products, or with cross cutters, for example for a non-stop operational program, and also in sheet fed printing machines, for example in sheet sorting devices. Another object of this invention is to provide such an improved diverting device which is reliable in operation and inexpensive to manufacture.

Still another object of this invention is to provide such an improved device which enables an exact division of a stream of products following rapidly one after the other at a high frequency either at a certain time or to control the division in such a manner that after a certain time point either one or the other direction is selected.

In keeping with these objects and others which will become apparent hereafter, one feature of this invention resides in a combination including the mounting of the guiding tongues on a tiltably supported shaft which is directly connected to one end of a cam follower arm which by means of a first biasing spring is urged into engagement with a cam disk, the cam disk being rotatable in a bearing and driven by a driving gear in synchronism with the machine cycles. The bearing of the cam disk and of the driving gear being mounted on the free end of a rocking arm whose other end is supported for rocking movement in a pivot point on the machine frame. The rocking arm is linked to a central portion of a rocker bar whose ends are linked to armatures of two solenoids acting in opposite directions relative to each other to move stepwise the rocking arm into different positions.

In a modified embodiment of this invention the movement of the rocking arm is limited by an abutment on the machine frame. The arm is spring loaded against the abutment by a second spring which is weaker than the spring of the cam follower lever. A spring loaded first pawl is linked to an armature of one solenoid and cooperates with a free end portion of the rocking arm to limit is movement away from to the fixed abutment. A second spring-loaded pawl is linked to the other solenoid and cooperates with an abutment provided on the free end of the cam follower lever to lock the same in predetermined positions.

In the preferred embodiment of this invention, the cam disk is firmly connected to an intermediate gear which meshes with a driving gear connected to a main driving shaft of the machine which is coaxial with the pivot axis of the rocking arm.

The advantages of the solution according to the invention reside particularly in the fact that the sheet-like products or sheets supplied in a processing machine at a high feeding rate at regular time intervals can be either alternately diverted in different feeding directions or after a certain time point diverted into one of two feeding directions. It is of particular advantage that in any application it is possible to achieve an exact kinematic synchronization for the actuation of the rocker bar. The switchover of operating conditions is performed in concert with this synchronization and is not limited to the time period of a gap between the supplied sheets. Moreover, the start of the switchover process can begin at a time point at which the trailing edge of the preceding sheet-shaped product has not yet reached the diverting edge of the guiding tongue when viewed in the intended new direction of transportation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
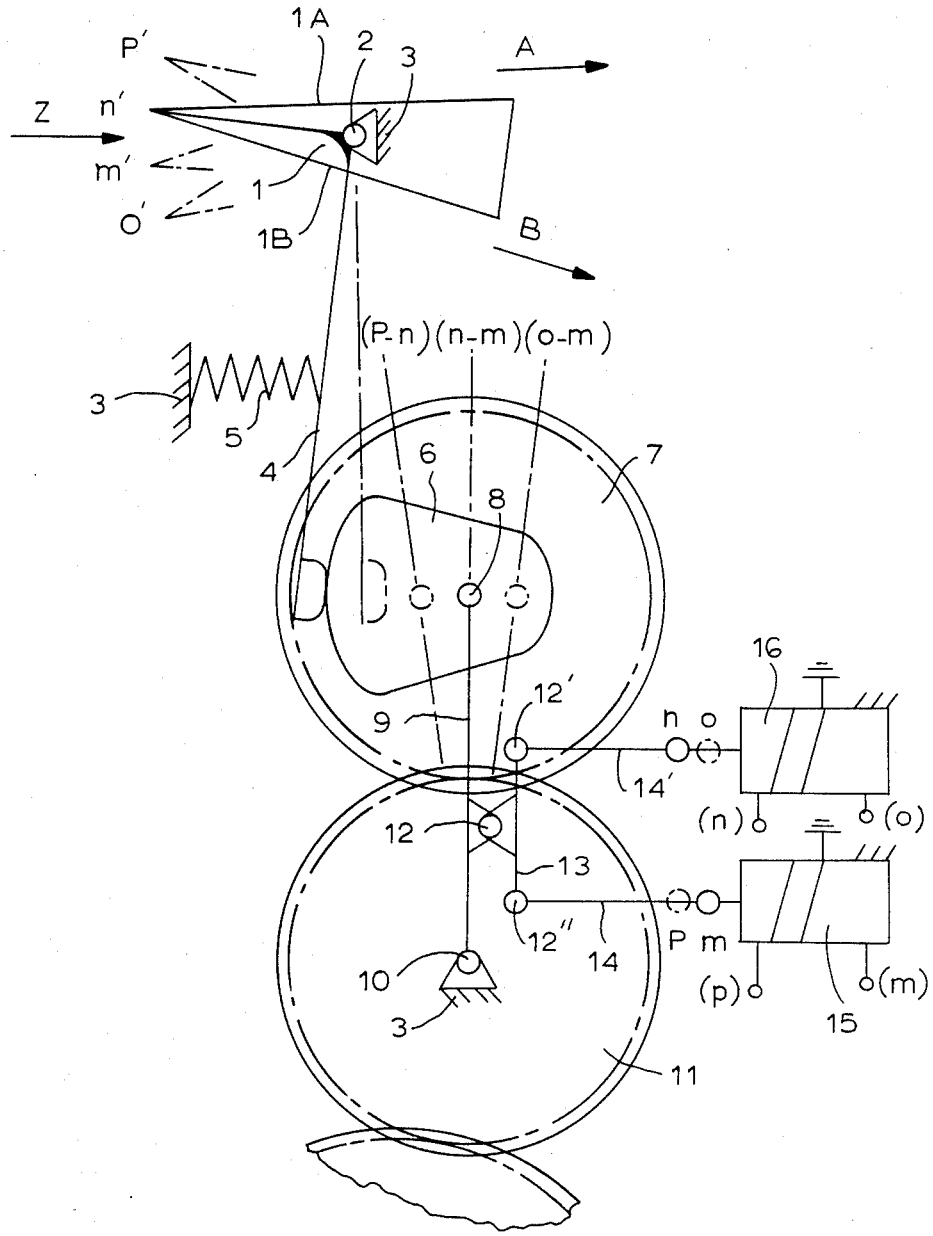
FIG. 1 is a schematic side view of one embodiment of the device of this invention.

A series of sheet-shaped products or sheets arrive in the direction of arrow Z from a non-illustrated processing machine in a conventional manner, for example conveyed on non-illustrated conveying bands, rollers or on a transfer cylinder. Depending on the position of the diverting edge of the guiding tongue 1 relative to the stream Z of conveyed products, namely whether the diverting edge is below or above the conveyed products, the latter are diverted to run either in the direction A along the guiding side 1A or in the direction B along the guiding side 1B and are conveyed in the diverted directions by conventional means. In practice, a plurality of guiding tongues 1 are fixed side by side on a pivot shaft 2 which is supported for rotation on a machine frame 3. A cam follower lever 4 is rigidly connected at one end thereof to the pivot shaft 2 and is spring-loaded by a pressure spring 5 to resiliently engage at its free a cam disk 6. The cam disk 6 is fixed to a side of a gear 7 and rotates jointly with the latter in a pivot bearing 8. It will be seen from FIGS. 1 and 2, the pivot bearing 8 is mounted on a free end portion of a rocking arm 9 whose other end is secured to a pivot joint 10 supported for rotation on the machine frame 3. The pivot joint is coaxial with the axis of rotation of the driving gear 11 meshing with the main driving gear of the machine and with the gear 7 of the cam disk 6. The shaft of the driving gear 11 is also supported for rotation on the machine frame and the gear 11 thus drives the cam disk 6 in synchronism with the machine cycles. The cam disk 6 is shaped with high and low camming surfaces whose sizes depend respectively on the time of passage of a product or sheet over the diverting edge of the guide tongue and whose ascending or descending surfaces are designed to match the gaps between the products. Subject to the selection of the operational mode "feeding direction A" or "feeding direction B", or "alternate feeding directions A and B", the working arm 9 which supports the cam disk 6 keeps taking such positions at which the guiding tongues 1 are oriented relative to the product stream in the directions corresponding to the selected operational mode.

For the positioning of the rocking arm 9 various constructions of the device of this invention are possible of which only two are illustrated and described.

Referring to FIG. 1, the rocking arm 9 is linked at the joint 12 with a central part of a rocker arm 13 whose ends are linked via additional joints 12' and 12'' and connected rods 14' and 14 to armatures of control solenoids 15 and 16 acting in opposite directions relative one to another. The positions of solenoids 15 and 16 are electrically adjustable and determine the position of the free end of the rocking arm and hence the position of the cam disk 6 relative to the cam follower lever 4.

In the operational mode "alternate feeding of sheets in directions A and B" the armatures of respective solenoids 15 and 16 are electrically set to positions n and m by applying voltage to coil terminals (n) and (m). The pivot bearing 8 of the cam disk 6 in this case is situated in a central position (n-m) indicated by full lines in FIG. 1 and accordingly the diverting edge of guiding tongues 1 reciprocates in synchronism with the machine cycles between positions m' and n'. If it is desired to divert the entire product stream in the direction A, solenoid 16 is switched over into position o indicated by dash and dot lines. Accordingly, the pivot bearing 8 of the cam disk 6 is displaced into right hand position (o-m) indicated by dashed lines and the guiding tongues 1 move back and forth between the points m' and o'. As a consequence, the stream Z of the conveyed products runs on the upper guiding side 1A of the tongues and all products are diverted in a single direction A only. In analogous fashion all products can be diverted in the direction B when armatures of solenoids 15 and 16 are simultaneously displaced into positions n and p. The switchover of solenoids 15 and 16 is accomplished by conventional switching means which need not be described in detail for the purposes of this invention.

In a modification, instead of changing the angular position of the pivot bearing 8 it is possible to change the position of the pivot shaft 2 while the position of the pivot bearing 8 remains constant.

Figure 2:
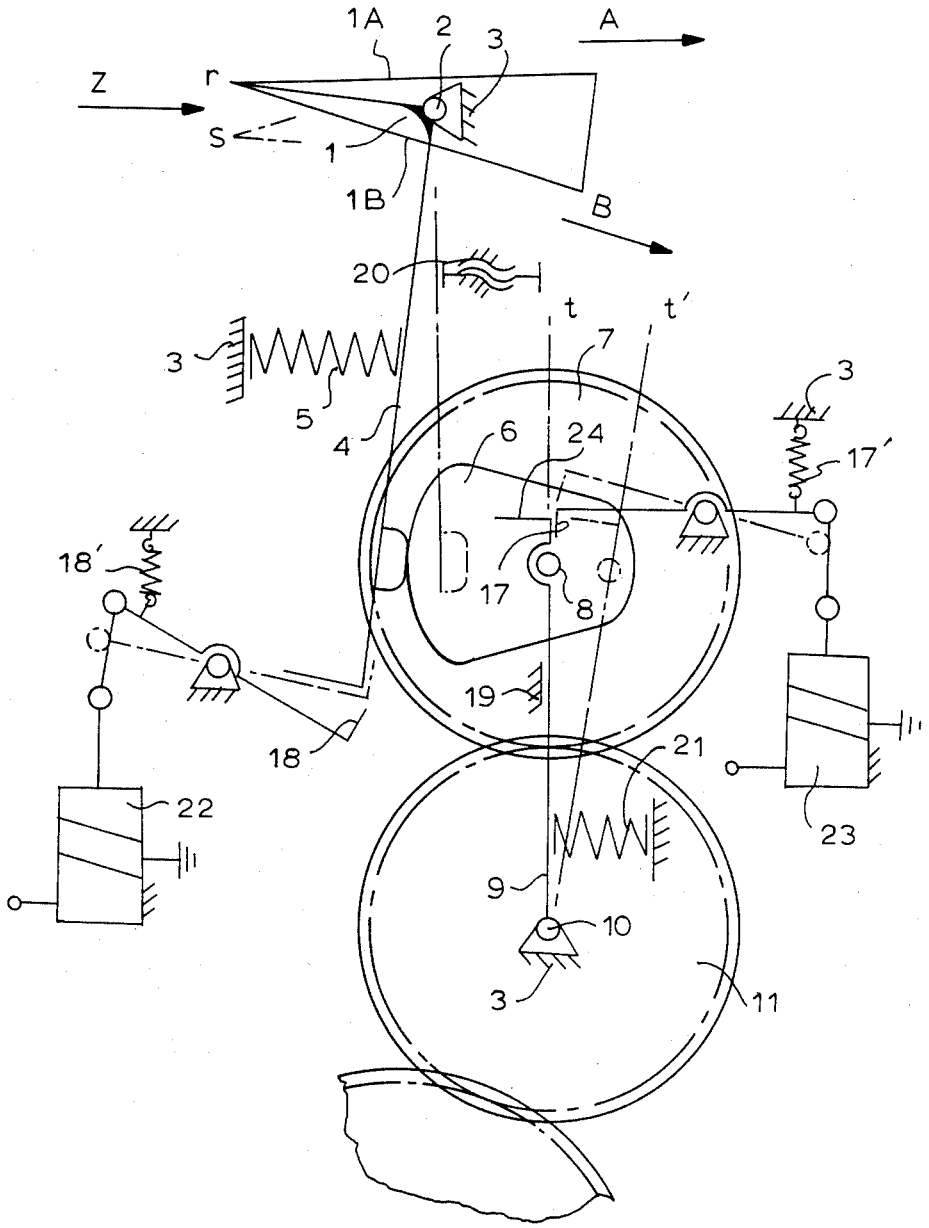
FIG. 2 is a schematic side view of another embodiment.

In a second embodiment of this invention illustrated in FIG. 2 the arrangement of driving members and machines elements 1 through 11 is substantially the same as in the embodiment of FIG. 1. The principal difference is in the modification of the locking arm 9 and of the cam follower lever 4 and also in the provision of electromagnetically activated locking pawls 17 and 18 for determining the selected operational modes.

In the operational mode "alternate feeding in directions A and B" the stop pawl 17 is brought by tensioning spring 17' into a position illustrated in full line in FIG. 2 in which it locks the rocking arm against the fixed abutment 19. The second locking or stop pawl 18 is tilted by tensioning spring 18' into the position illustrated in full line in which it disengages the cam follower lever 4 thus permitting its free movement. Accordingly, the cam disk 6 moves the cam follower lever 4 back and forth in synchronism with the machine cycles between the positions r and s of the diverting edge of the guiding tongue 1 and the stream of products is alternately diverted in directions A and B. If it is desired to retain the guiding tongues in the position s in order to divert the entire product stream in the direction A, the solenoid 23 is energized. Due to the force of pressure spring 5 acting via the cam follower lever 4, the cam disk 6 and the rocking arm 9 on the first stop pawl 17, the latter can switch over from its illustrated position when the force of spring 5 is taken up by an adjustable limit stop 20 cooperating with the cam follower lever 4 in such a manner that the latter abuts against the stop in an intermediate position of the cam disk. The low cam surface only slightly releases the cam follower lever from the limit stop 20. In the intermediate cam disk position, the first stop pawl 17 releases the rocking arm 9 which springs under the action of pressure spring 21 from position t to position t'. The strength of pressure spring 21 is less than that of the pressure spring 5 so that the cam follower lever 4 remains on the limit stop 20 and consequently the guiding tongues 1 remain in the position s.

In the alternating mode of operation the synchronized switchover of the tongues into the original position can be enforced only then when the rocking arm 9 is in position t at which the first stop pawl 17 is allowed by the action of tension spring 17' to lock the rocking arm on the abutment 19. In all other positions, a stop surface 24 formed at right angles at the free end of the rocking arm prevents the pawl 17 to move into its locking position. Similarly, the fixation of the guiding tongues in the diverting position r is effected by the stop pawl 18. The high camming surface of the cam disk 6 moves the cam follower lever 4 in a position in which the second stop pawl 18 when actuated by the second solenoid 22 can rotate against the force of spring 18' into engagement with the right-hand side of the cam follower lever. In all preceding positions, this locking engagement was prevented by the stop surface 25 formed at right angles at the free end of the cam follower lever.

The force of pressure spring 5 which holds the cam follower lever in engagement with the second pawl 18 can be overcome by the biasing spring 18' upon inactivation of solenoids 22 only at the time point at which the high camming surface of cam disk 6 moves the cam follower lever away from the second stop pawl 18 thus guaranteeing that the diverting edge of tongue 1 is moved in synchronism with the occurrence of gaps between the conveyed series of products. Among others it is also conceivable in a further modification of this invention to design a first stop pawl 17 so as to act immediately on the cam follower lever 4.

From the above described operation of the two embodiments of this invention it is evident that the diverting device provides both high switching frequency and well defined switching cycles accurately correlated to the feeding rate of the processed sheets in any selected operational mode. The embodiment of FIG. 1 shows a design in which the swinging of the cam is controlled substantially electrically whereas in the embodiment of FIG. 2 a mechanical adjustment for controlling the product diverting positions is of greater importance.

While the invention has been illustrated and described as embodied in specific examples of a sheet diverting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for diverting a stream of sheet-shaped products supplied in a feeding direction at a rate synchronized with the cycles of a sheet product processing machine into different directions according to a selected mode of operation, comprising a guiding tongue pivotably supported on a machine frame to engage and guide the incoming sheet-shaped products; a cam disk driven for rotation in synchronism with the machine cycles; a cam follower lever connected to said guiding tongue and being biased by a first pressure spring to engage said cam disk and to pivot the guiding tongue into different diverting positions; a rocking arm pivotably supported at one end thereof on the machine frame and supporting for rotation said cam disk; and control means for tilting said rocking arm together with the driven cam disk to different fixed angular positions.

2. A device as defined in claim 1, wherein said control means includes a rocking bar hinged at its center to said rocking arm and being linked at each end thereof to armatures of reciprocating solenoids selectively energized to move the rocking arm in three different fixed positions relative to said cam follower lever.

3. A device as defined in claim 1 comprising a driving gear supported for rotation on the machine frame coaxially with a pivot axis of the rocking arm and a driven gear coaxially secured to said cam disk and being in mesh with said driving gear to rotate the cam disk in synchronism with the machine cycles.

4. A device as defined in claim 1, wherein said control means includes first and second stop pawls each controlled by a solenoid, an abutment surface on said machine frame, a second pressure spring for urging said rocking arm into engagement with said abutment surface, said second pressure spring being weaker than said first pressure spring, an adjustable limit stop provided on said machine frame to engage said cam follower lever in a fixed position and biasing springs acting on respective stop pawls to lock in dependency on the angular position of said cam disk, said rocking arm in a position in engagement with the abutment surface and to lock the cam follower lever in a position remote from said adjustable limit stop.

5. A device as defined in claim 4, wherein said solenoids are energized to selectively release said rocking arm and said cam follower lever from their locking positions.

* * * * *